US005596680A

United States Patent [19]

Chow et al.

[11] Patent Number: 5,596,680

[45] Date of Patent: Jan. 21, 1997

[54] METHOD AND APPARATUS FOR DETECTING SPEECH ACTIVITY USING CEPSTRUM VECTORS

[75] Inventors: Yen-Lu Chow, Saratoga; Erik P. Staats, Felton, both of Calif.

[73] Assignee: Apple Computer, Inc., Cupertino, Calif.

[21] Appl. No.: 999,128

[22] Filed: Dec. 31, 1992

[51] Int. Cl.[6] ..... G10L 5/06; G10L 9/00

[52] U.S. Cl. ..... 395/257; 395/2.59; 395/2.62; 395/2.64

[58] Field of Search ..... 395/2, 2.5, 2.54, 395/2.57, 2.62, 2.22, 2.31, 2.59, 2.64

[56] References Cited

U.S. PATENT DOCUMENTS

| | | | |
|---|---|---|---|
| 4,310,721 | 1/1982 | Manley et al. | 395/2.2 |
| 4,348,553 | 9/1982 | Baker et al. | 395/2.5 |
| 4,783,804 | 11/1988 | Juang et al. | 395/2.54 |
| 4,821,325 | 4/1989 | Martin et al. | 395/2.62 |
| 4,860,355 | 8/1989 | Copperi | 381/36 |
| 4,903,305 | 2/1990 | Gillick et al. | 395/2.54 |
| 4,945,566 | 7/1990 | Mergel et al. | 395/2.62 |
| 5,027,406 | 6/1991 | Roberts et al. | 395/2 |
| 5,056,150 | 10/1991 | Yu et al. | 395/2.43 |
| 5,091,948 | 2/1992 | Kametani | 381/42 |
| 5,241,619 | 8/1993 | Schwartz et al. | 395/2 |

OTHER PUBLICATIONS

Fast Endpoint detection Algorithm for Isolated and Recognition in office environment.

Dermatas et al. ICASSP–91 p. 733–736 vol. 1 May 1991 Explicit Estimation of Speech boundaries.

Taboada et al. IEE proceedings–Science, Measurement and Technology p. 153–159 —May 1994.

"Speech Recognition, Neural Nets, And Brains" by George M. White, Jan. 1992.

"Large–Vocabulary Speaker–Independent Continuous Speech Recognition: The SPHINX System"by Kai–Fu Lee, Carnegie Mellon University, Pittsburgh, Pennsylvania, Apr. 1988.

"Digital Representations of Speech Signals" by Ronald W. Schafer and Lawrence R. Rabiner, The Institute of Electrical and Electronics Engineers, Inc., 1975, pp. 49–63.

"Speech Recognition by Machine: A Review" by D. Raj Reddy, IEEE Proceedings 64(4):502–531, Apr. 1976, pp. 8–35.

"Vector Quantization" by Robert M. Gray, IEEE, 1984, pp. 75–100.

Markel, J. D. and Gray, Jr., A. H., "Linear Production of Speech," Springer, Berlin Herdelberg New York, 1976.

Rabine, L., Sondhi, M. and Levison, S., "Note on the Properties of a Vector Quantizer for LPC Coefficients, "BSTJ, vol. 62, No. 8, Oct. 1983, pp. 2603–2615.

Linde, Y., Buzo, A., and Gray, R. M., "An Algorithm for a Vector Quantization," IEEE Trans. Commun., COM–28, No. 1 (Jan. 1980) pp. 84–95.

Bahl, I. R., et al., "Large Vocabulary National Language Continuous Speech Recognition," Proceeding of the IEEE CASSP 1989, Glasgow.

Gray, R. M., "Vector Quantization",IEEE ASSP Magazine, Apr. 1984, vol. 1, No. 2, p. 10.

(List continued on next page.)

*Primary Examiner*—Allen R. MacDonald
*Assistant Examiner*—Richemond Dorvil
*Attorney, Agent, or Firm*—Blakely, Sokoloff, Taylor & Zafman

[57] ABSTRACT

A method and apparatus for detecting speech activity in an input signal. The present invention includes performing begin point detection using power/zero crossing. Once the begin point has been detected, the present invention uses the cepstrum of the input signal to determine the endpoint of the sound in the signal. After both the beginning and ending of the sound are detected, the present invention uses vector quantization distortion to classify the sound as speech or noise.

31 Claims, 7 Drawing Sheets

OTHER PUBLICATIONS

Bahl, L. R., Baker, J. L., Cohen, P. S., Jelineck, F., Lewis, B. L, Mercer, R. L., "Recognition of a Continuously Read Natural Corpus", IEEE Int. Conf. on Acoustics, Speech and Signal Processing, Apr. 1978.

Schwartz, R., Chow, Y., Kimball, O., Roucos, S., Krasner, M., Makhoul, J., "Context–Dependent Modeling for Acoustic–Phonetic Recognition of Continuous Speech," IEEE Int. Conf. on Acoustics, Speech and Signal Processing, Apr. 1985.

Schwartz, R. M., Cow, X. L., Roucos, S., Krauser, M., Makhoul, J., "Improved Hidden Markov Modeling of Phonemes for Continuous Speech Recognition," IEEE Int. Conf. on Acoustics, Speech and Signal Processing, Apr. 1984.

Alleva, F.Hon, H., Huang, X., Hwang, M., Rosenfeld, R., Weide, R., "Applying Sphinx II to DARPA Wall Street Journal CSR Task", Proc. of the DARPA Speech and NL Workshop, Feb. 1992, Morgan Kaufman Pub., San Mateo, CA.

Kai–Fu Lee, "Automatic Speech Recognition," Kluwer Academic Publishers, Boston/Dordrecht/London, 1989.

METHOD AND APPARATUS FOR DETECTING SPEECH ACTIVITY USING CEPSTRUM VECTORS

FIELD OF THE INVENTION

The present invention relates to the field of continuous speech recognition; more particularly, the present invention relates to detecting of speech activity.

BACKGROUND OF THE INVENTION

Recently, speech recognition systems have become more prevalent in today's high-technology market. Due to advances in computer technology and advances in speech recognition algorithms, these speech recognition systems have become more powerful.

Fundamental to all speech recognition systems is the manner in which the speech signal is represented. The speech signals are often represented according to their characteristics. When characterizing a speech signal, typically a short-term analysis approach is utilized in which a window, or frame (i.e., a short time interval) is isolated for spectral analysis. By using the short time analysis approach, speech can be analyzed on a time-varying basis.

One of the simplest representations of a signal which may be used to analyze a signal on a time-varying basis is its energy or power. Power provides a good measure for separating voiced speech segments from unvoiced speech segments. Usually, the energy for unvoiced segments is much smaller than for voiced segments. For very high quality speech, the power can be used to separate unvoiced speech from silence.

Another time domain analysis method is based on zero crossing measurements. For digitized speech signals, a zero crossing occurs between consecutive samples if the sign of each of the samples is the opposite of each other. Zero crossings are often used as an estimate of the frequency content of a speech signal. However, the interpretation of the zero crossings as applied to speech is much less precise due to the broad frequency spectrum of most sound signals. Zero crossings are also often used in making a decision about whether a particular segment of speech is voiced or unvoiced. If the zero crossing rate is high, the implication is unvoiced, while if the zero crossing rate is low, the segment is most likely to be voiced.

Although speech is analyzed as a time varying process normally, speech is also viewed on a short-time basis as the convolution of the excitation and vocal tract components associated with speech. The useful technique for integrating the convolution function into speech analysis is called "Cepstrum" analysis. In cepstrum, or cepstral analysis, the spectral envelope associated with the speech signal is separated from the norm due to the voiced sound by use of the Fourier transform of the logarithm of the spectrum. One well-known cepstrum technique is referred to as linear predictive coding (LPC). For more information, refer to Markel, J. D. and Gray, Jr., A. H., "Linear Production of Speech," Springer, Berlin Herdelberg New York, 1976.

Specifically, in cepstral analysis, the log-power spectrum is computed from the speech signal. Then the cepstrum is computed by taking the inverse Fourier transform of the log-power spectrum. Next, pitch extraction is performed, wherein a peak is located within a pitch range, a voiced to unvoiced decision is performed, and the pitch period is computed. Lastly, for cepstral analysis the spectral envelope is computed by windowing the cepstrum to remove the pitch effects and then taking the Fourier transform of the windowed cepstrum. In this manner, the cepstrum analysis is used for computing the spectral envelope and the pitch period.

A variety of types of speech recognition systems are in use today. One such type is commonly referred to as a continuous, or connected, speech recognition system. Continuous speech recognition systems are hierarchical in that entire phrases and sentences are recognized and grouped together to form larger units, as opposed to the recognition of single words.

In continuous speech, in order to recognize an utterance (i.e., a phrase or sentence), a determination must be made as to where the beginning and ending parts of each word are. Detection of the beginning and ending of individual phrases is usually referred to as end point detection. When the signal-to-noise ratio is high, the determination of the end points is not difficult. However, most speech recognition is not performed in environments with high signal-to-noise ratios. Therefore, weak fricatives and low-amplitude voiced sounds occurring at the end points of the utterance become difficult to detect, resulting in errors in their recognition. Most of the end point detection schemes of the prior art use some form of energy and zero crossing techniques. However, these energy and zero crossing techniques of the prior art are inadequate in dealing with noise (both transient and background).

Once the beginning and ending points of the utterances have been identified, the sound must be recognized. Currently, large numbers of words must be matched to the utterance during the recognition process. In an effort to reduce the amount of processing required, vector quantization has been used.

Vector quantization (VQ) techniques have been used to encode and decode speech signals for the purpose of data bandwidth compression. More specifically, in speech recognition systems, vector quantization has been used for preprocessing of speech data as a means for obtaining compact descriptors through the use of a relatively sparse set of codebook vectors to represent large dynamic floating point vector elements. For more information on vector quantization, see Gray., R. M., "Vector Quantization", IEEE ASSP Magazine, April, 1984, Vol. 1, No. 2. Once the data has been quantized, a recognition algorithm is used to perform the matching.

As will be shown, the present invention provides a method and apparatus for performing speech activity detection.

SUMMARY OF THE INVENTION

It is an object of the invention to produce a high performance speech activity detection module.

It is another object of the invention to produce a speech activity detection system that discriminates between silence and sound.

It is yet another object of the invention to produce a speech activity detection system that discriminates between speech and noises.

It is still another object of the invention to produce a speech activity detection system that minimizes computation in the recognition system.

These and other objects of the present invention are provided by a method and means for detecting the endpoint of speech in an input signal. The present invention includes a method and means for generating a cepstrum vector representing the spectrum of each sample in the input signal. The present invention also provides a method and means for generating a cepstrum vector for the steady state portion of the input signal. The present invention provides a method and means for comparing the cepstrum vector of each sample with the cepstrum vector for the steady state portion of the input signal, such that the endpoint of speech is located where the spectrum converges to the steady state portion of the input signal.

These and other objects of the present invention are also provided by a method and means for detecting speech activity in an input signal. The method and means for detecting speech activity include a method and means for detecting the power and zero crossings of the input signal to determine the begin point of the sound in the input signal, a method and means for determining the cepstral norm of the input signal to determine the end point of the sound in the input signal, and a method and means for comparing the current cepstral vector with a speech codebook and a noise codebook, such that the sound is classified as speech or noise according to the distortion between current cepstral vector and a speech codebook and a noise codebook.

BRIEF DESCRIPTION OF DRAWINGS

The present invention will be understood more fully from the detailed description given below and from the accompanying drawings of the preferred embodiment of the invention, which, however, should not be taken to limit the invention to the specific embodiment but are for explanation and understanding only.

DETAILED DESCRIPTION OF THE INVENTION

A method and means for performing speech recognition are described. In the following description, numerous specific details are set forth such as specific processing steps, recognition algorithms, acoustic models, etc., in order to provide a thorough understanding of the present invention. It will be obvious, however, to one skilled in the art that the present invention may be practiced without these specific details. In other instances, well-known speech recognition processing steps and circuitry have not been described in detail to avoid unnecessarily obscuring the present invention.

The Overview of a Computer System in the Preferred Embodiment

Figure 1:
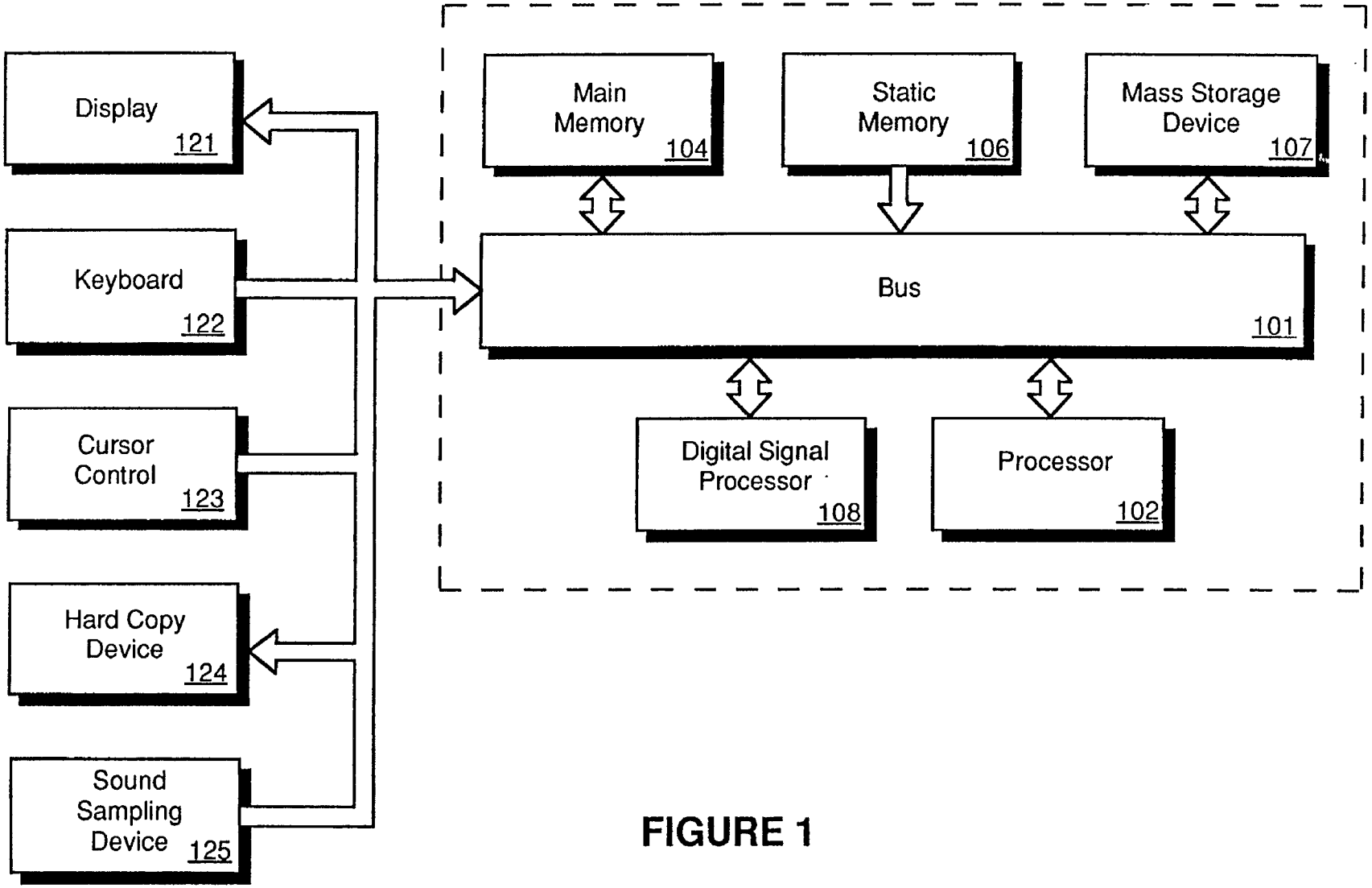
FIG. 1 is a block diagram of the computer system which may be utilized by the preferred embodiment of the present invention.

The preferred embodiment of the present invention may be practiced on computer systems having alternative configurations. FIG. 1 illustrates some of the basic components of such a computer system, but is not meant to be limiting nor to exclude other components or combinations of components. Referring to FIG. 1, the computer system upon which the preferred embodiment of the present invention is implemented is shown as 100. Computer system 100 comprises a bus or other communication means 101 for communicating information and a processing means 102 coupled with bus 101 for processing information. Computer system 100 further comprises a random access memory (RAM) or other dynamic storage device 104 (referred to as main memory), coupled to bus 101 for storing information and instructions to be executed by processor 102. Main memory 104 also may be used for storing temporary variables or other intermediate information during execution of instructions by processor 102. Computer system 100 also comprises a read only memory (ROM) and/or other static storage device 106, coupled to bus 101 for storing static information and instructions for processor 102, and a mass data storage device 107, such as a magnetic disk or optical disk and its corresponding disk drive. Mass storage device 107 is coupled to bus 101 for storing information and instructions.

Computer system 100 may further comprise a coprocessor or processors 108, such as a digital signal processor, for additional processing bandwidth. Computer system 100 may further be coupled to a display device 121, such as a cathode ray tube (CRT), coupled to bus 101 for displaying information to a computer user. An alphanumeric input device 122, including alphanumeric and other keys, may also be coupled to bus 101 for communicating information and command selections to processor 102. An additional user input device is cursor control 123, such as a mouse, a trackball, or cursor direction keys, coupled to bus 101 for communicating direction information and command selections to processor 102, and for controlling cursor movement on display 121. Another device which may be coupled to bus 101 is hard copy device 124 which may be used for printing instructions, data, or other information on a medium such as paper, film, or similar types of media. System 100 may further be coupled to a sound sampling device 125 for digitizing sound signals and transmitting such digitized signals to processor 102 or digital signal processor 108 via bus 101. In this manner, sounds may be digitized and then recognized using processor 108 or 102. In one embodiment, sound sampling device 125 includes a sound transducer (microphone or receiver) and an analog-to-digital converter.

In a preferred embodiment, system 100 is one of the Macintosh® brand family of personal computers available from Apple Computer, Inc. of Cupertino, Calif., such as various versions of the Macintosh® II, Quadra, etc. (Macintosh® and Apple® are registered trademarks of Apple Computer, Inc.). Processor 102 is one of the Motorola 680x0 family of processors available from Motorola, Inc. of Schaumburg, Ill., such as the 68020, 68030, or 68040. Processor 108, in a preferred embodiment, comprises one of the AT&T DSP 3210 series of digital signal processors available from American Telephone and Telegraph (AT&T) Microelectronics of Allentown, Pa. System 100, in a preferred embodiment, runs the Macintosh® brand operating system, also available from Apple Computer, Inc. of Cupertino, Calif.

Functional Overview of the Speech Recognition System

Figure 2:
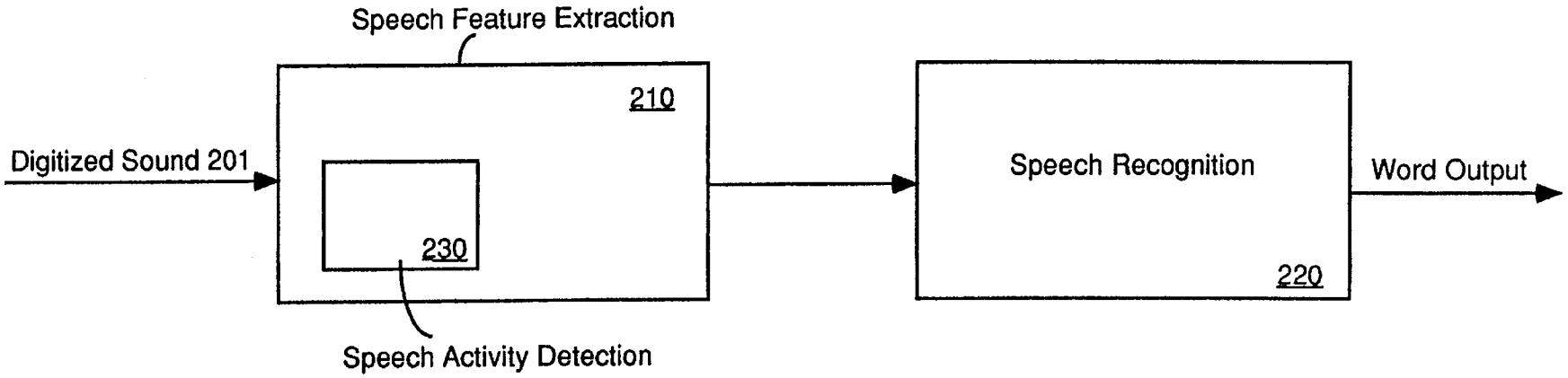
FIG. 2 is a block diagram of the speech recognition system of the present invention.

The system of the preferred embodiment is implemented as a series of software routines that are run by processor 102, which interacts with data received from digital signal processor 108 via sound sampling device 125. It can be appreciated by one skilled in the art, however, that in an alternative embodiment, the present invention may be implemented in discrete hardware or firmware. The preferred embodiment is represented in the functional block diagram of FIG. 2 as 200. Digitized sound signals 201 are received from a sound sampling device such as 125 shown in FIG. 1, and are input to a circuit for speech feature extraction 210 which is otherwise known as the "front end" of the speech recognition system. The speech feature extraction process 210 is performed, in the preferred embodiment, by digital signal processor 108. This feature extraction process 210 recognizes acoustic features of human speech, as distinguished from other sound signal information contained in digitized sound signals 201. In this manner, features such as phones or other discrete spoken speech units may be extracted, and analyzed to determine whether words are being spoken. Spurious noises such as background noises and user noises other than speech are ignored.

In the currently preferred embodiment, speech feature extraction 210 uses a method of speech encoding known as linear predictive coding (LPC). LPC is a filter parameter extraction scheme which yields roughly equivalent time or frequency domain parameters. In other words, the LPC parameters represent a time varying model of the formants or resonances of the vocal tract (without pitch).

In the currently preferred embodiment, once the acoustic voice signal is digitized, the signal is converted into segmented blocks of data, each block overlapping the adjacent blocks by 50%. Then windowing is applied to create a window, commonly of the Hamming type, to each block for the purpose of controlling spectral leakage. The output is processed by an LPC unit that extracts the LPC coefficients $\{a_k\}$ that are descriptive of the vocal tract formant all pole filter. The LPC unit has not been shown to avoid unnecessarily obscuring the present invention.

Then cepstral processing is performed which transforms the LPC coefficient parameter $\{a_k\}$ to a set of informationally equivalent cepstral coefficients. The set of cepstral coefficients define the filter in terms of the logarithm of the filter transfer function. The result of the transformation is the output of the speech feature extraction process 210 and comprises a cepstral data vector, $C=[c_1\ c_2 \ldots c_P]$. Note that although the currently preferred embodiment employs a LPC cepstrum, a Fast Fourier Transform (FFT) cepstrum may also be utilized in conjunction with the present invention.

The acoustic features from the speech feature extraction process 210 are input to a recognizer process 220 which performs speech recognition using a language model to determine whether the extracted features represent expected words in a vocabulary recognizable by the speech recognition system. In the currently preferred embodiment, recognition process 220 uses a recognition algorithm to compare a sequence of frames produced by an utterance with a sequence of nodes contained in the acoustic model of each word in the active vocabulary to determine if a match exists. The result of the recognition matching process is either a textual output or an action taken by the computer system which corresponds to the recognized word. In the currently preferred embodiment, the speech recognition algorithm employed is the Hidden Markov Model (HMM).

In the currently preferred embodiment, the speech feature extraction process 210 produces a set of cepstral data vectors, each of which is applied to a vector quantizer. The result of the vector quantization of the cepstral data vector is a quantized cepstral vector. These quantized cepstral data vectors are then quantized in and used by speech recognition 220 to produce the word output of the recognized word.

The speech activity detection block 230 in the speech feature extraction block 210 detects speech activity for the present invention. The speech detection performed by block 230 uses an adaptive cepstrum technique. Speech activity detection block 230 also discriminates between silence and sound, as well as discriminates between speech and noises, such as beeps, clicks, phone rings, etc. Furthermore, speech activity detection block 230 of the present invention minimizes computation that typically must be performed by the recognition system.

Speech Activity Detection In the Present Invention

Figure 3:
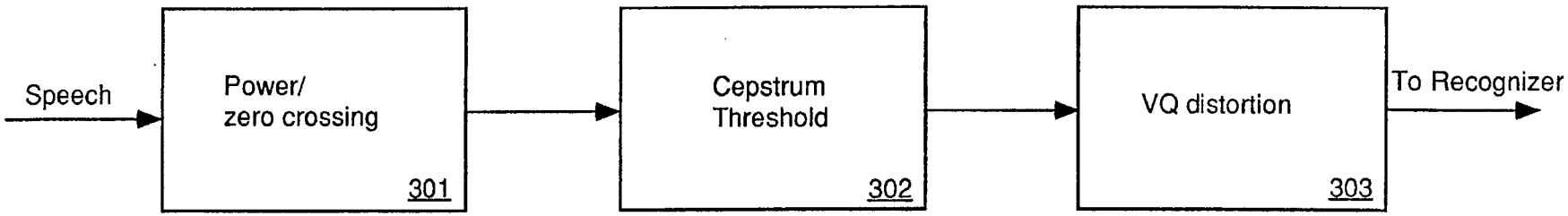
FIG. 3 is a block diagram of the speech activity detection processing of the present invention.

The present invention utilizes a multi-stage approach to detecting speech activity. In the currently preferred embodiment, three stages are used to detect speech activity for an input acoustic signal. FIG. 3 depicts the currently preferred embodiment of the speech activity detection block. Referring to FIG. 3, the three stages of the speech activity detection block are shown as power/zero crossing block 301, cepstrum threshold block 302 and vector quantization (VQ) distortion block 303. A sound waveform is received by the power/zero crossing processing block 301. The output of power/zero crossing block 301 is coupled to the cepstrum threshold processing block 302. The output of the cepstrum threshold processing block 302 is coupled to the input of VQ distortion processing block 303. The output of VQ distortion processing block 303 is coupled as an input to the recognizer of the speech recognition system.

In the currently preferred embodiment, power/zero crossing processing block 301 detects the beginning point of speech in an input sound waveform. Cepstrum threshold processing block 302 performs end point detection on the sound waveform. VQ distortion processing block 303 performs sound classification to determine whether the sound waveform is speech or noise. In other words, VQ distortion processing block 303 discriminates between speech and noise in the sound waveform. If VQ distortion processing block 303 determines that the sound waveform represents speech, then the sound waveform, in its processed state, is permitted to proceed to the speech recognition stage. On the other hand, if VQ distortion processing block 303 determines that the sound waveform represents noise, then the sound waveform is not permitted to proceed to the speech recognition stage. Note that VQ distortion block 303 is not required for the present invention to operate correctly. In other embodiments, the function of discriminating between speech and noise could be the sole responsibility of the speech recognizer of the speech recognition system.

POWER AND ZERO CROSSINGS

In the present invention, power and zero crossing models voiced sounds and fricatives in order to detect the beginning point of speech in an input sound waveform. Power is the energy contained in a speech waveform. Zero crossings is a measure of the rate at which the waveform is changing. The concepts of power and zero crossing are well-known in the art. Note that power and zero crossing models are employed in the currently preferred embodiment to perform this function. However, it should be noted that other beginning point detection techniques and schemes may be employed. For instance, the beginning point could be detected using a cepstrum technique or a vector quantization technique.

In one embodiment, the power of the sound waveform is used to model voicing (i.e., determine when a voiced sound occurs), and the zero crossing rate of the sound waveform is used to model fricatives. In other words, in one embodiment, the power is used to model voiced sounds, such as vowels "a", "e", "i", etc, while the zero crossings model the sounds which have lower energy content but are rapidly changing due to air turbulence (i.e., fricatives such as "f", "s", "sh", etc.). In the present invention, it is assumed that every word contains a voice sound with the possibility of a fricative preceding the sound.

Figure 4:
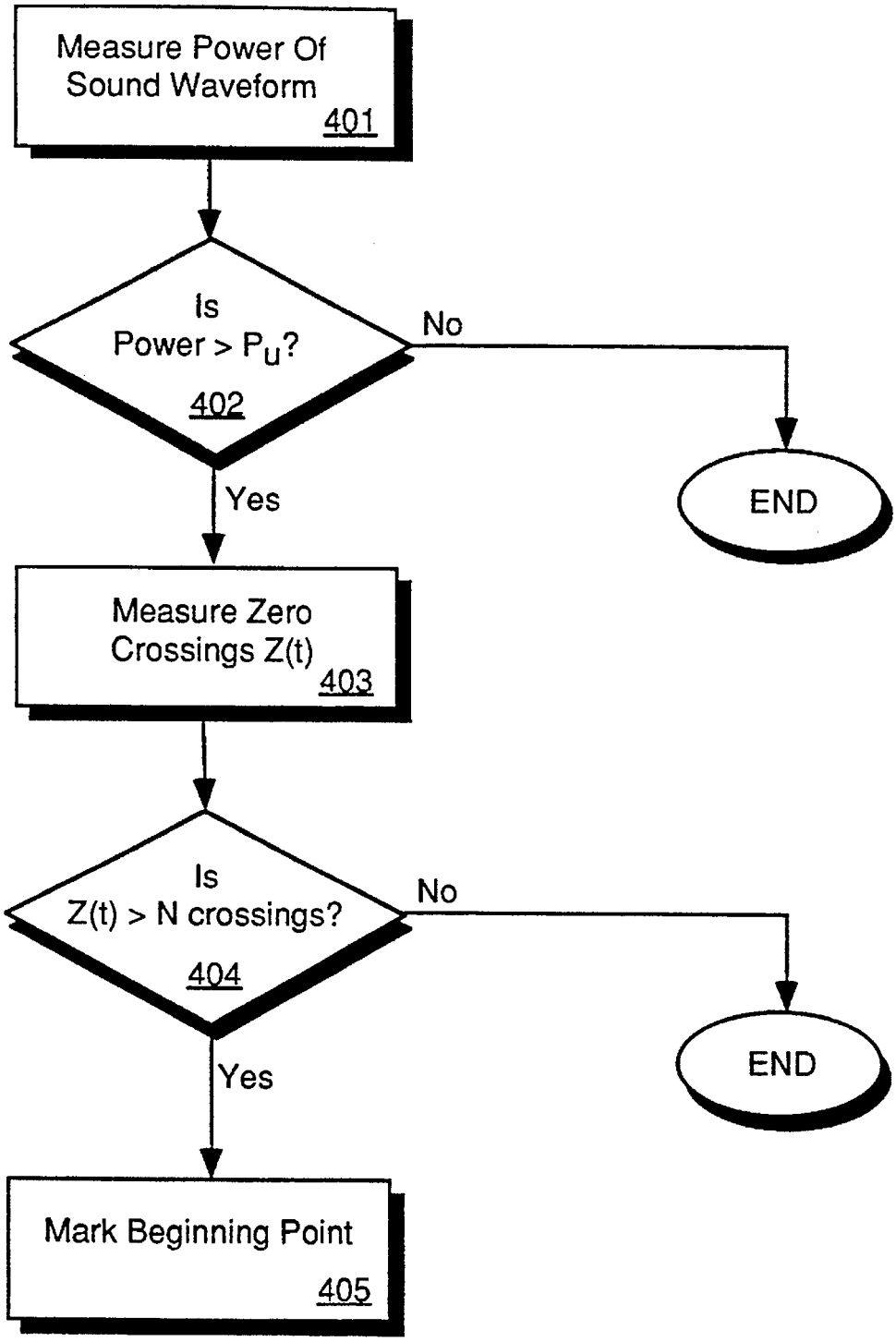
FIG. 4 is a flow chart depicting the power and zero crossing method of the present invention.

A flow chart of the power and zero crossings method of the present invention is shown in FIG. 4. Power/zero-crossing processing begins by finding a point in the sound waveform that exceeds an upper power threshold $P_U$ (Processing blocks 401 and 402). In the currently preferred embodiment, this power threshold $P_U$ is large. Once the power of the waveform exceeds the threshold $P_U$ in a predetermined number of frames, $B_s$, then voicing is assumed to exist. In the currently preferred embodiment, the power of the waveform must exceed the threshold for five frames (i.e., $B_s$=5), where each of the frames is 20 milliseconds (ms) in length, in order for voicing to be considered to exist.

After the beginning of the voicing is determined, the zero crossings are used to find any low power, fricative sounds which might precede the voicing. The speech waveform is searched backwards for a maximum number of frames, $A_s$ (processing block 403). In the present invention, if the zero crossing rate is found to exceed a certain threshold for a predetermined number of times, N, during the maximum number frames $A_s$ (processing block 404), then the first zero crossing is marked as the beginning of the speech (processing block 405). In the currently preferred embodiment, the maximum number of frames $A_s$ is ten.

For finding the end point of the speech, the power is constantly compared to a lower power threshold $P_L$. Once the power falls below the threshold $P_L$ for a predetermined number of frames, $B_e$, the end of the voicing is said to exist and that point of the sound waveform is marked as such. Next, the zero crossing rate is compared to a zero crossing threshold. If the rate exceeds the zero crossing threshold for N times in $A_e$ frames, then the end of speech is marked at the last occurrence where the zero crossing rate exceeded the threshold. In this manner, ending fricatives are modeled in the present invention.

Implementation of Power and Zero Crossings

In one embodiment, the power and zero crossing stage can be implemented to operate on either isolated utterances or large, continuous files of floating point numbers. Note that in the present invention most of details for either of these implementations are the same, with exceptions as noted.

In the currently preferred embodiment, to obtain the power and zero crossing rate thresholds, the first 100 ms of speech is assumed to be silence (i.e., background noise). Therefore, the noise is modeled as a Gaussian (i.e., the norm) by sampling the first 100 ms for its power and zero crossing rate. In the currently preferred embodiment, during the first 100 ms, the window size is 2 ms in order to obtain a more accurate measure of the standard deviation.

The power is calculated by summing the absolute values of the window and dividing it by the window size. In other words, in the currently preferred embodiment, power $P_n$ is calculated according to the equation:

$$P_n = \sum_{t=wn}^{w(n+1)} |s(t)|$$

where w equals the window width and n equals the frame index. This power calculation is referred to as the magnitude power calculation. In another embodiment, power could be calculated using the square of the power (i.e., $s^2(t)$). In the currently preferred embodiment, the window width w is equal to 20 milliseconds, with the exception of during the first 100 ms (i.e., during threshold determination) when the window size is 2 ms. In the currently preferred embodiment, the zero crossing rate is obtained by counting only positive zero crossings and dividing by the window size. In the currently preferred embodiment, zero crossings $Z_n$ are determined according to the equation:

$$Z_n = \text{Number of Positive zero crossings in the interval } [wn, w(n+1)]$$

During the first 100 ms, the number of zero crossings are determined every 2 ms and the Gaussian parameters are calculated after fifty samples are taken. In one embodiment, the norm is recalculated every 200 ms if speech has not been detected so that changes can be made to the norm if the noise level changes.

Once the thresholds have been established, the power/zero crossing processing of the present invention is performed. The present invention uses a dual threshold system to reduce false starts. In one embodiment, the magnitude version, the low power threshold ($P_L$) is the power mean plus the power standard deviation. In another embodiment, the low power threshold ($P_L$) is the power means plus 1.8 times the power standard deviation. The upper power ($P_U$) threshold is the power mean plus a predetermined number A times the power standard deviation. In one embodiment, the magnitude version, the predetermined number A is 31.0. In the squared power version, the predetermined number A is 115.0. In both versions, the zero crossing rate threshold is the zero crossing mean plus the standard deviation of the zero crossing rate.

To find the beginning point, power and zero crossing rates are calculated constantly for a pair of windows. In the currently preferred embodiment, the power and zero crossing rates are calculated constantly for 20 ms non-overlapping windows. The values are stored in a circular buffer of size $A_s$+$B_s$ for zero crossing rate and $B_s$ for power (where $A_s$ is the maximum number of frames in which the zero crossing rate is checked to exceed a certain threshold when checking for fricative sounds and $B_s$ is the number of frames the power of the waveform must exceed the upper power threshold). In the currently preferred embodiment, $A_s$ equals 10 frames and $B_s$ equals 7 frames. The zero crossing rate buffer is larger because in the present invention there is a search backwards once the beginning of the sound is found.

The power is then compared to the lower power threshold $P_L$. Once the power exceeds this point, the frame is marked as a possible beginning. Next, the power must stay above this threshold and exceed the upper power threshold $P_U$. However, the power is allowed to fall below $P_L$ for a certain number of frames to allow for small bursts at the beginning of the utterance followed by a short pause. In the currently preferred embodiment, the power is allowed to fall below $P_L$ for at most two frames.

Once the power exceeds the upper power threshold $P_U$, the marked frame becomes the beginning of the voicing sound. If the power falls below $P_L$ for more than two frames, the marking is removed. If the marked frame is more than $B_s$ frames before exceeding $P_U$, then the zero crossing rate is not searched because it is assumed that a long-drawn out voicing with very low power, which is representative of a glide (i.e., "r" or "y") or liquid type (i.e., "l" or "w") sound, has occurred. Otherwise, the zero crossing rate is searched for N crossings in $A_s$ frames. If N crossings are found, then the first crossing is marked as the fricative beginning. In the currently preferred embodiment, N is 3.

Finding the end point is symmetrical. The power must stay below $P_L$ for $B_e$ frames. In the currently preferred embodiment, $B_e$=7. Once the endpoint is found, the waveform is monitored for $A_e$ frames for a predetermined number of crossings. In the currently preferred embodiment, $A_e$=15 frames. Furthermore, in the currently preferred embodiment, the number of crossings that are monitored for $A_e$ frames is three crossings. The third crossing is marked as the end of fricative, if found.

Figure 5A:
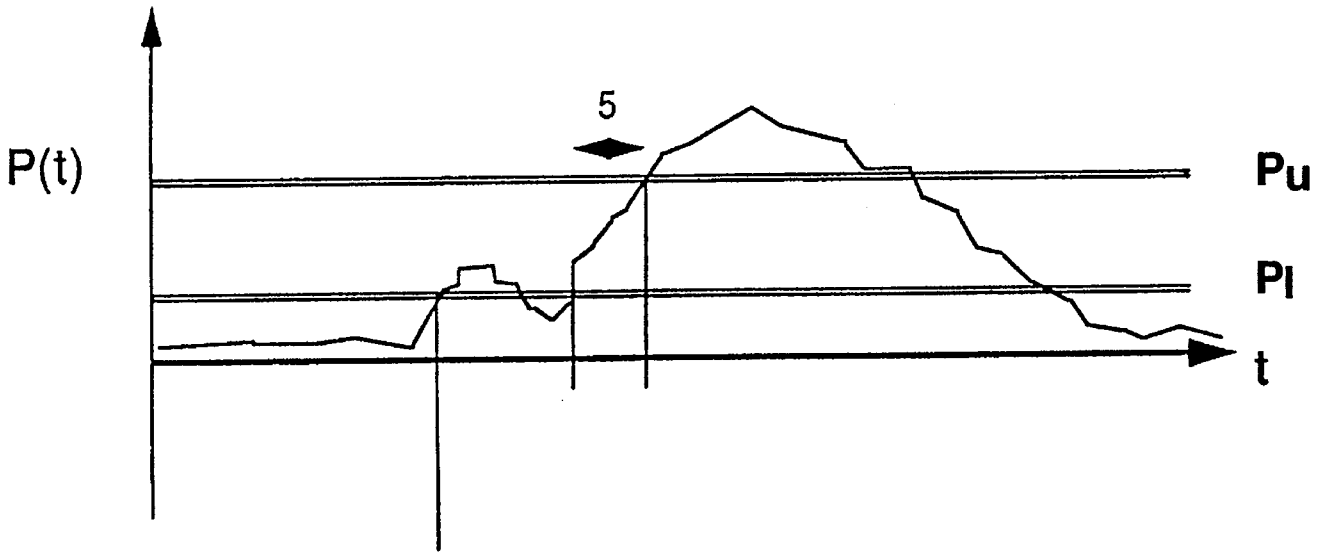
FIGS. 5A and 5B are timing diagrams illustrating the power and zero crossing of the present invention.
Figure 5B:
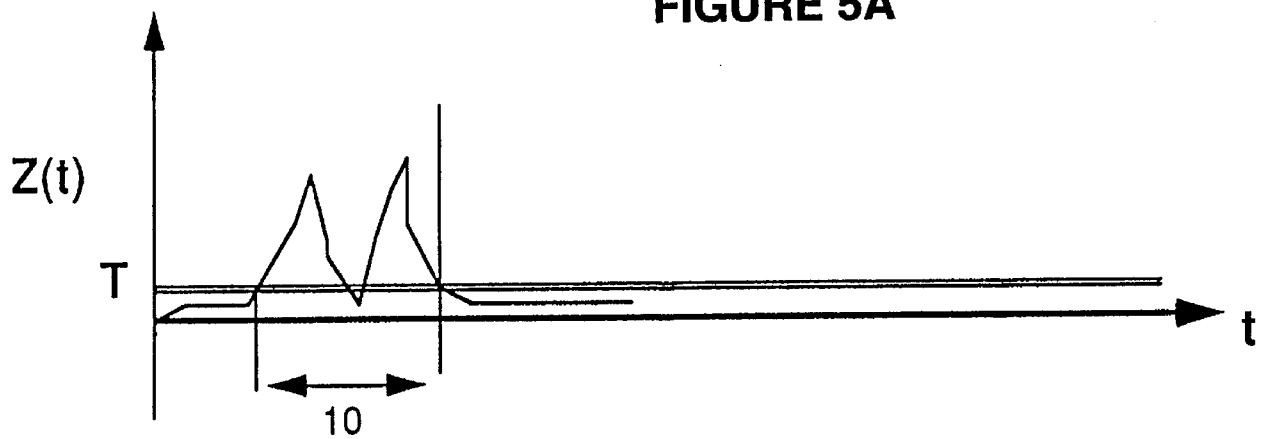

FIGS. 5A and 5B are timing diagrams that together illustrate the power and zero crossings method of the present invention. FIG. 5A is a timing diagram of the power of the speech waveform and FIG. 5B is a timing diagram of the zero crossings of the speech waveform. Therefore, the present invention employs a threshold based system, wherein when the power exceeds a particular threshold, some type of voiced sound is said to exist. Then the preceding portion of the received sound waveform is searched for regions of high zero crossing. If regions of high zero crossing exist, then the beginning of region of high zero crossing is determined to be the beginning of sound.

CEPSTRUM THRESHOLD FOR ENDING POINT DETECTION

In the currently preferred embodiment, the end point of speech is detected using a cepstrum threshold. By using the cepstrum threshold, the speech recognition system of the present invention is able to better deal with background noise. In the present invention, it is assumed that the speech spectrum varies rapidly while the noise spectrum remains relatively constant.

Figure 6:
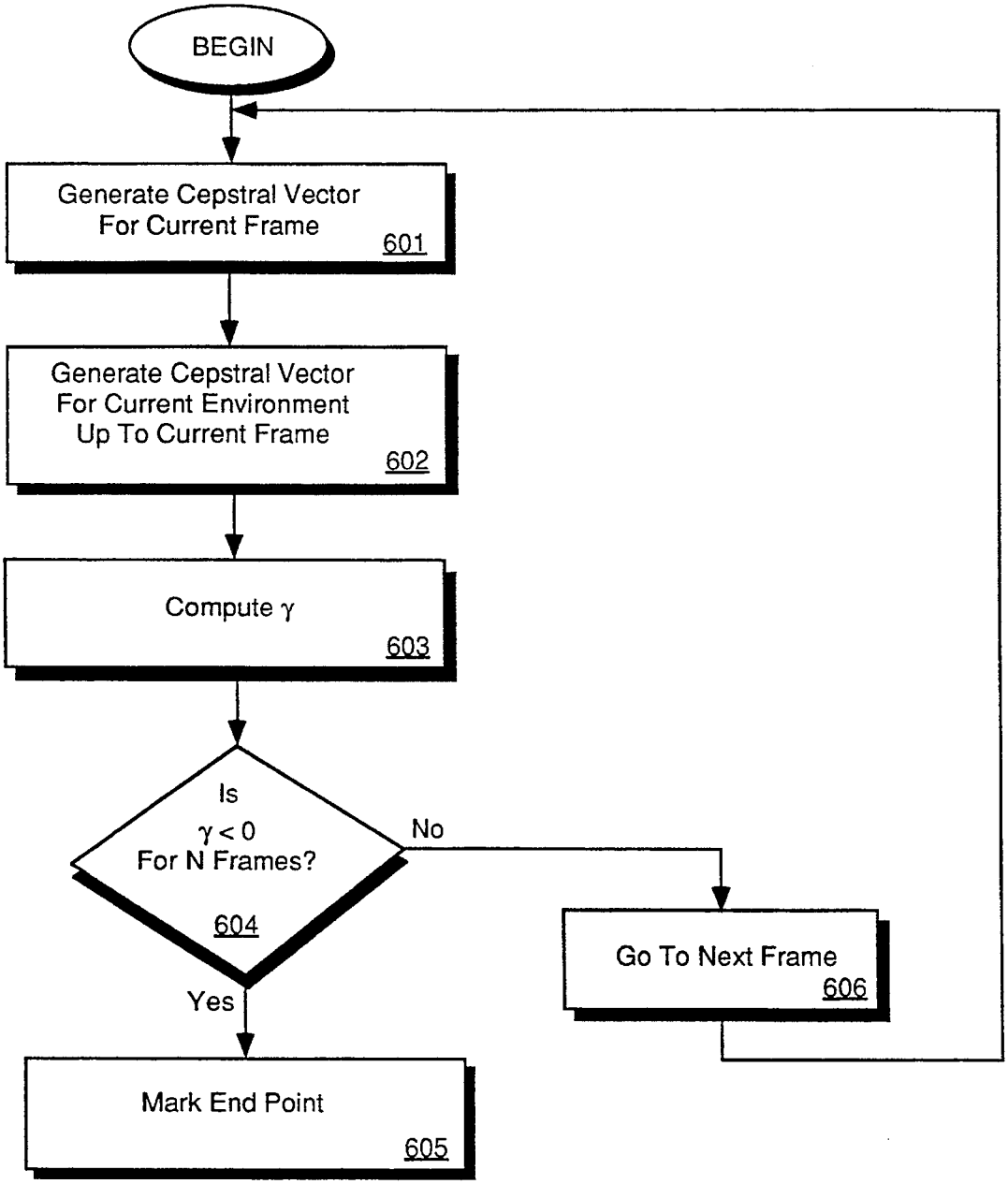
FIG. 6 is a flow chart depicting the cepstrum threshold process to detect the end point according to the present invention.

The end point detection scheme of the present invention is shown in the flow chart of FIG. 6. In the present invention, using the cepstrum threshold for end point detection generally requires two steps. Referring to FIG. 6, the cepstrum is computed for each of the frames (i.e., windows) of the input signal (processing block 601). A constant steady state portion of the input signal is identified. The steady state portion of the input signal is the portion signal that remains relatively the same and does not change quickly. In the currently preferred embodiment, the steady state portion of the input signal is located by finding the constant cepstrum vector (processing block 602). With the cepstrum computed and the constant cepstrum vector computed, the end point of speech is found when the spectrum begins to converge to the steady state spectrum. In the currently preferred embodiment, the steady state spectrum represents the noise spectrum. In other words, when the spectrum looks like the steady state portion of input signal, the input signal is converging to silence.

In the currently preferred embodiment, the ending point is marked when the measure of speech to silence $\gamma$ (processing block 603) is less than zero for a predetermined number of frames (processing block 604). In the currently preferred embodiment, the ending point is marked when the measure of speech to silence $\gamma$ is less than zero for 40 consecutive frames, where each frame is 10 ms in length (processing block 605); otherwise, the process continues at the next frame (processing block 606).

Implementation of Cepstrum Threshold End Point Detection

The end point detection module of the present invention is a cepstral-based process. When a new cepstrum is read in, the measure of the speech to silence is computed for the cepstrum. The measure corresponding to the new cepstrum is averaged with a predetermined number of the past average measures to produce an average measure of speech versus silence. In the currently preferred embodiment, the predetermined number of past average measures used to produce an average measure of speech versus silence is 3. If this average measure exceeds a speech threshold for a minimum number of frames, the beginning of speech is detected. In the currently preferred embodiment, the speech threshold is 0.6 and the minimum number of frames which the average measure must exceed the speech threshold is 7. In the currently preferred embodiment, the speech threshold is chosen empirically.

Once speech is detected, if the average measure remains below a silence threshold for a minimum number of frames, the end of speech is detected. In the currently preferred embodiment, the silence threshold is 0.4 and the minimum number of frames which the average measure must exceed the silence threshold is 40 frames. In the currently preferred embodiment, the silence threshold is chosen empirically. The minimum number of frames to detect the end of speech (i.e., silence) is longer in order to compensate for pauses made by the user between words within an utterance. Thus, in the currently preferred embodiment of the present invention, the minimum pause length to end an utterance is 400 ms.

To compute the measure of the speech versus the silence, an average cepstrum vector is computed every frame. The average cepstrum vector represents the steady state background noise. When a new cepstrum is read in, its distance from the average cepstrum is computed and used as its measure of the speech versus silence. Specifically, in the currently preferred embodiment, the cepstral vector representing the current environment up to frame n is determined according to the equation below:

$$Y_n \alpha Y_{n-1} + (1-\alpha) X_n$$

where $X_n$ represents the current cepstral vector of frame n and $\alpha$ equals 0.99. Once the cepstral vector representing the current environment has been determined, a measurement for speech to silence $\gamma$ is computed. The measure $\gamma$ represents the deviation or variance from the long term environment (Y), such that in the present invention speech is more likely for large variances and noise is more likely for little variances. In the currently preferred embodiment, the measure $\gamma$ is determined according to the equation of the norm below:

$$\gamma = \|Y_{n-1} - X_n\|^2 - \theta_e$$

where the ending point threshold $\theta_e$ is the silence threshold and is 0.40 in the currently preferred embodiment. Thus, in the currently preferred embodiment, the cepstrum norm is determined and it is compared to a threshold to determine the variance. Note that the other formulas could be used to generate a measurement $\gamma$. For instance, an absolute value measurement could be used.

Note that the average cepstrum is computed during speech even though the speech is not the background noise. However, the speech is not steady state, so the end point detection process of the present invention will not trigger the end of speech until the speech has actually stopped and steady state background noise cepstrals are read in. By detecting the average cepstrum vector (i.e., the background or steady state) for each frame, the present invention can compensate for changes in ambient noise because each new measurement includes the current environment when determining the steady state.

VECTOR QUANTIZATION (VQ) DISTORTION CLASSIFICATION OF SOUNDS

After the end point of the sound has been detected, the currently preferred embodiment of the present invention uses vector quantization to classify the sounds as either noise or speech. By using VQ distortion, the present invention is able to compensate for transient noise. To perform the sound classification, the present invention computes the distortion between the input cepstrum vector, corresponding to a frame of the sound sampling, and two codebooks, one for speech and one for noise. A codebook is a collection of representative cepstral vectors for the specific sound class. The use of codebooks in vector quantization is well-known in the art.

In the present invention, the codebooks are computed for each sound type to be classified. In other words, the codebooks used in classification are initially trained. In the currently preferred embodiment, two codebooks are trained, one using truncated speech cepstrum and one using truncated noise cepstrum, i.e., one codebook is computed for speech and one codebook is computed for noise. In the currently preferred embodiment, the codebook for speech contains 256 representative cepstral vectors and the codebook for noise contains 64 representative cepstral vectors.

Figure 7:
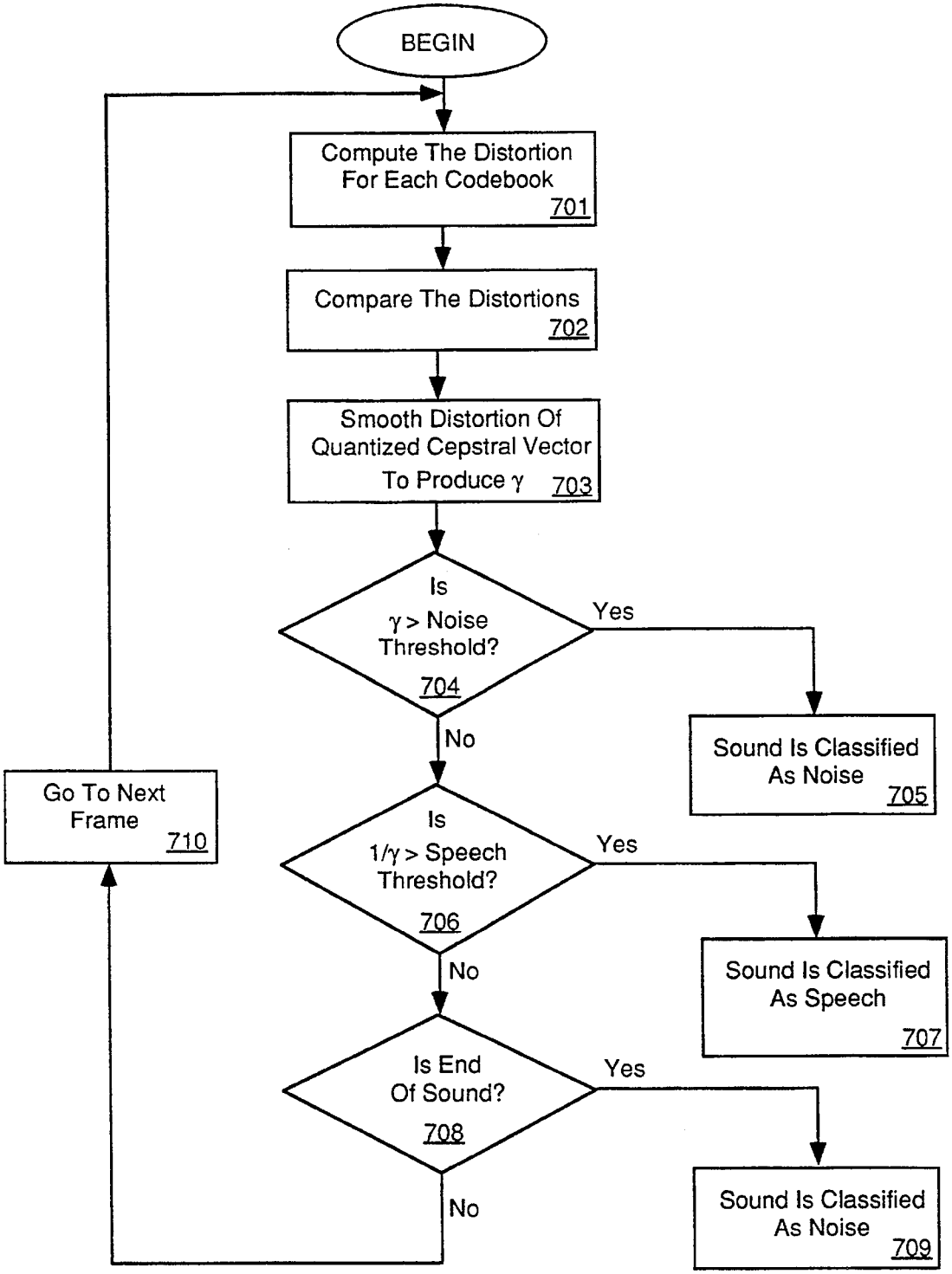
FIG. 7 is a flow chart depicting the vector quantization distortion stage of the present invention.

FIG. 7 is a flow chart of the vector quantization distortion stage of the present invention. In the present invention, given an input cepstrum vector X, the distortion from each of the codebooks is computed (processing block 701). In one embodiment, if the speech distortion is large and the noise distortion is small, then the sound is most likely noise. In other words, if the ratio of the distortion from the speech codebook to the distortion from the noise codebook is greater than a noise threshold, then the sound is classified as noise. On the other hand, if the noise distortion is large and the speech distortion is small, the sound is most likely speech. In other words, if the ratio of the distortion from the noise codebook to the distortion from the speech codebook is greater than a speech threshold, then the sound is classified as speech. In the currently preferred embodiment, the ratios are inverses of each other. Since the ratios are inverses of each other, the thresholds used are positive values greater than one.

In the currently preferred embodiment, the distortions are smoothed over a frame length of variable duration (W). The distortions are initially determined and the distortion of the quantized cepstral vector from the two codebooks is compared as follows (processing block 702):

$$\alpha_n = \frac{\Delta_s(X_n)}{\Delta_n(X_n)}$$

where $X_n$ is the nth cepstral vector, $\Delta_s$ is the distortion of $X_n$ when quantized by the speech codebook, and $\Delta_n$ is the distortion of $X_n$ when quantized by the noise codebook.

The distortion of the quantized cepstral vector is smoothed according to the following equation (processing block 703):

$$\gamma = \frac{1}{W} \sum_{k=n}^{n-w+1} \alpha_k$$

where W equals the smoothing window width. In the currently preferred embodiment, the smoothing window width W equals 1 frames, where each frame is 10 ms.

The distortion must exceed the same threshold N times in L smooth frames. That is, if the distortion $\gamma$ is greater than the noise threshold at least N times for L windows (processing block 704), then the present invention classifies the sound as noise (processing block 705), and if $1/\gamma$ is greater than the speech threshold at least N times for L windows (processing block 706), then the sound is speech (processing block 707). In the currently preferred embodiment, the variable duration L is 8 frames, the distortion must exceed the same threshold one time (i.e., N=8) over one smooth frame (i.e., W=1).

In the currently preferred embodiment, the vector quantization distortion process begins by searching the cepstrum from left to right. Each distortion is smoothed and the ratio of the speech to noise distortion is stored in a circular buffer. In the present invention, the size of the circular buffer for storing the ratio is equal to the number of frames L. In the currently preferred embodiment, the size of the circular buffer for storing the ratio is 8 frames long. The speech and noise classification conditions are checked. If no decision can be made, then the present invention continues to the next frame (processing block 710). In the currently preferred embodiment, no decision can be made if there are not enough crossings of either threshold or the values fall between the two thresholds. This process continues until the end of the sound is reached or a decision is made in the currently preferred embodiment, if no decision is made by the end of the sound (processing block 708), then the sound is classified as noise (processing block 709).

If the sound waveform is classified as speech, then the sound waveform, in its processed state, is permitted to proceed to the speech recognition stage. On the other hand, if the sound waveform is classified as noise, then the sound waveform is not permitted to proceed to the speech recognition stage.

The multi-stage speech activity detection mechanism of the present invention provides benefits to the speech recognition system. For instance, the power and zero crossings reduce digital sound processing load from fifty percent to a load less than five percent in one embodiment. Furthermore, use of the cepstrum threshold provides reliable end point detection and robustness to changing ambient noise. In other words, the end point will reliably be found in "steady state" background noise, and the present invention allows for adaptability in an environment that changes its ambient noise level. Also, the VQ distortion reduces the recognition computation in significantly noisy environments with minimal loss in accuracy. The present invention provides for better environmental adaptation by adapting only to sounds classified as speech since non-steady state noise will be rejected. Therefore, if environmental adaptation algorithms are utilized, the algorithms will perform more effectively because there will be no adaptation to non-steady state noise. For more information on environmental algorithms, see Alex Acero, *BSDCN* (PHD Thesis) Carnegie Mellon University, School of Computer Science, Pittsburgh, Pa. 1991.

Whereas many alterations and modifications of the present invention will no doubt become apparent to a person of ordinary skill in the art after having read the foregoing description, it is to be understood that the particular embodiment shown and described by way of illustration is in no way intended to be considered limiting. Therefore, reference to the details of the preferred embodiments are not intended to limit the scope of the claims which themselves recite only those features regarded as essential to the invention.

Thus, a method and apparatus for detecting speech activity has been described.

We claim:

1. A method for detecting an endpoint of speech in an input signal, wherein the input signal is sampled, said method comprising the steps of:

generating cepstrum vectors representing each spectrum of individual samples of the input signal;

generating a cepstrum vector for a steady state portion of the input signal; and comparing the cepstrum vectors of individual samples with the cepstrum vector for the steady state portion of the input signal to identify the endpoint of speech as that portion of the input signal having a spectrum that converges to the steady state portion of the input signal.

2. The method as defined in claim 1 wherein the endpoint of speech is located where the spectrum of said portion of the input signal begins to converge to the steady state portion of the input signal.

3. The method as defined in claim 1 further comprising the steps of:

generating a measure of speech to silence for a current frame corresponding to a current cepstrum based on the current cepstrum and a cepstrum indicative of a steady state portion of the input sound; and determining if the measure exceeds a predetermined speech threshold for a predetermined number of frames, such that the beginning point of speech is detected when the measure exceeds the predetermined speech threshold for a first predetermined number of frames.

4. The method as defined in claim 3 wherein the step of generating the measure comprises the steps of:

generating a plurality of speech to silence measures, wherein one of the plurality of speech to silence measures corresponds to each cepstrum; and averaging the speech to silence measure for the current frame with speech to silence measures of a predetermined number of previous frames to produce an average measure; and detecting when the average measure exceeds the predetermined speech threshold for a predetermined number of frames to identify speech.

5. The method as defined in claim 3 further comprising the step of detecting the end of speech when the measure remains below a silence threshold for a second predetermined number of frames.

6. The method as defined in claim 3 wherein the first predetermined number of frames comprises a plurality of consecutive frames.

7. The method as defined in claim 3 wherein the step of generating the measure includes the steps of:

computing an average cepstrum vector representing steady state background noise of the speech activity; and computing a distance from the cepstrum to the average cepstrum vector as the measure of speech to silence for the current frame.

8. The method as defined in claim 3 wherein the step of generating the average measure comprises averaging the current cepstrum with a number of cepstrums corresponding to a predetermined number of frames prior to the current frame.

9. A method for detecting speech activity in an input signal comprising the steps of:

detecting a beginning point of speech in the input signal;

detecting an ending point of speech in the input signal, wherein the step of detecting an ending point of speech comprises the steps of computing an average cepstrum vector for each frame to represent a steady state portion of the input signal, comparing cepstrum vectors for individual speech samples with the average cepstrum vector, including the step of determining distance of a current cepstrum vector for an individual speech sample from the average cepstrum vector to determine a variance, and identify the ending point of speech when the variance is at least at a predetermined variance indicative of whether the ending point of speech has been detected.

10. The method as defined in claim 9 wherein the step of detecting the beginning point of speech comprises the steps of:

measuring energy contained in the input signal to determine the presence of voiced sound, wherein voiced sound occurs when the energy of the input signal is above a predetermined threshold; and measuring zero crossings, such that the beginning point of speech is located in the input signal where a total number of zero crossings is greater than a predetermined number of zero crossings.

11. The method as defined in claim 9 further comprising the step of performing vector quantization to classify the input signal, such that the input signal is discriminated between speech and noise.

12. The method as defined in claim 11 wherein said step of performing vector quantization includes the step of determining distortion between each input cepstrum vector and a plurality of representative cepstral vectors for each sound type being classified.

13. The method as defined in claim 12 wherein each plurality of representative cepstral vectors for each sound type to be classified comprises a codebook.

14. A method for detecting speech activity in an input signal having a beginning point and an ending point, said method comprising the steps of:

detecting the beginning point of speech in the input signal;

detecting the ending point of speech in the input signal using cepstrum vectors, wherein the step of detecting the ending point of speech comprises the step of comparing the cepstrum vectors of individual speech samples of the input signal with a cepstrum vector for a steady state portion of the input signal to identify the ending point of speech;

classifying the sound as speech or noise, such that speech recognition occurs on the input signal when the sound is classified as speech and speech recognition does not occur on the input signal when the sound is classified as noise.

15. The method as defined in claim 14 wherein the step of classifying comprises the steps of:

computing a first distortion between a current cepstral vector and a codebook for speech;

computing a second distortion between the current cepstral vector and a codebook for noise;

comparing a first ratio of the first distortion and second distortion to a first threshold, such that sound of the input signal is classified as speech if the first ratio is less than the first threshold at least a first predetermined number of times for a first predetermined number of windows; and comparing a second ratio of the second distortion and the first distortion to a second threshold, such that sound of the input signal is classified as noise if the second ratio is less than the second threshold at least a second predetermined number of times for a second predetermined number of windows.

16. The method as defined in claim 15 further comprising the step of classifying sound in the input signal as neither speech or noise if the first ratio is greater than the first threshold and the second ratio is greater than the second threshold.

17. The method as defined in claim 15 wherein the step computing the first distortion and the step of computing the second distortion each comprises determining average distortion over a predetermined number of frames of the input signal.

18. The method as defined in claim 15 wherein the first threshold is an inverse proportion of the second threshold.

19. A method for detecting speech activity in an input signal comprising the steps of:

detecting the power and zero crossings of the input signal to determine a beginning point of sound in the input signal;

detecting an end point of sound in the input signal, wherein the step of detecting an end point of sound comprises the steps of generating cepstrum vectors representing each spectrum of individual samples of the input signal, generating a cepstrum vector for a steady state portion of the input signal, and comparing the cepstrum vectors of individual speech samples for each frame with the cepstrum vector representing a steady state portion of the input signal and identifying the end point of sound as the point of the input signal where the current cepstrum vector converges to the cepstrum vector representing the steady state; and comparing the current cepstral vector with a speech codebook and a noise codebook, such that the sound is classified as speech or noise according to the distortion between current cepstral vector and a speech codebook and a noise codebook.

20. A system for recognizing speech from an input signal comprising:

speech activity detection means for detecting speech in the input signal, wherein said speech activity detection means comprises means for detecting power and zero crossings of the input signal to determine a beginning point of sound in the input signal;

means for generating cepstral vectors representing each spectrum of individual samples of the input signal;

means for generating a cepstral vector for a steady state portion of the input signal;

means for comparing cepstral vectors of individual samples with the cepstral vector for the steady state portion of the input signal to identify the endpoint of speech as that portion of the input signal having a spectrum that converges to the steady state portion of the input signal; and means for comparing a current cepstral vector with a speech codebook and a noise codebook, such that sound in the input signal is classified as speech or noise according to a distortion between the current cepstral vector and a speech codebook and a noise codebook, wherein if the sound is classified as speech then the current cepstral vector is output as an output speech signal; and a recognition engine for receiving the output speech signal and recognizing the speech, such that at least one recognized word is generated.

21. A method of detecting speech activity in a data input stream comprising the steps of:

(a) generating a set of spectral representation vectors to represent the data input stream, wherein each spectral representation vector of the set of spectral representation vectors represents a predetermined portion of the data input stream;

(b) generating a steady state spectral representation vector indicative of the state of the data input stream at a first predetermined portion of the data input stream;

(c) comparing a spectral representation vector corresponding to the first predetermined portion of the data input stream to the steady state spectral representation vector; and (d) determining a first end point of speech activity when the set of spectral representation vectors converges toward the steady state spectral representation vector.

22. The method of claim 21, further comprising the step of:

(e) determining a second end point of speech activity when the set of spectral representation vectors diverges from the steady state spectral representation vector.

23. The method of claim 22, wherein the step (e) comprises determining the second end point of speech activity when a predetermined number of spectral representation vectors of the set of spectral representation vectors are within a predetermined distance of the steady state spectral representation vector for a continuous predetermined period of time.

24. The method of claim 22, further comprising the step of:

(f) determining whether the speech activity more closely resembles a speech codebook or a noise codebook.

25. The method of claim 24, wherein the step (f) comprises:

calculating a first distortion for each of a plurality of spectral representation vectors of the set of spectral representation vectors between each of the plurality of spectral representation vectors and the speech codebook;

calculating a second distortion for each of a plurality of spectral representation vectors of the set of spectral representation vectors between each of the plurality of spectral representation vectors and the noise codebook; and classifying the speech activity as speech, provided the first distortion is greater than a speech threshold for a first predetermined period of time, otherwise classifying the speech activity as noise, provided the second distortion is greater than a noise threshold for the first predetermined period of time.

26. The method of claim 21, wherein the step (d) comprises determining the first end point of speech activity when a predetermined number of spectral representation vectors of the set of spectral representation vectors are a predetermined distance away from the steady state spectral representation vector for a continuous predetermined period of time.

27. An apparatus for detecting speech activity in a data input stream comprising:

a memory unit;

an input device for receiving the data input stream;

a processor coupled to the memory unit and the input device, wherein the processor generates a set of spectral representation vectors to represent the data input stream and stores the set of spectral representation vectors in the memory unit, wherein each spectral representation vector of the set of spectral representation vectors represents a predetermined portion of the data input stream, wherein the processor also generates a steady state spectral representation vector indicative of the state of the data input stream at a first predetermined portion of the data input stream and compares a spectral representation vector corresponding to the first predetermined portion of the data input stream to the steady state spectral representation vector, and determines a first end point of speech activity when the set of spectral representation vectors converges toward the steady state spectral representation vector.

28. The apparatus of claim 27, wherein the processor determines a second end point of speech activity when the set of spectral representation vectors diverges from the steady state spectral representation vector.

29. The apparatus of claim 28, wherein the processor determines the second end point of speech activity when a predetermined number of spectral representation vectors of the set of spectral representation vectors are within a predetermined distance of the steady state spectral representation vector for a continuous predetermined period of time.

30. The apparatus of claim 28, wherein the processor also calculates a first distortion for each of a plurality of spectral representation vectors of the set of spectral representation vectors between each of the plurality of spectral representation vectors and a speech codebook, calculates a second distortion for each of a plurality of spectral representation vectors of the set of spectral representation vectors between each of the plurality of spectral representation vectors and the noise codebook, classifies the speech activity as speech, provided the first distortion is greater than a speech threshold for a first predetermined period of time, and classifies the speech activity as noise, provided the second distortion is greater than a noise threshold for the first predetermined period of time.

31. The apparatus of claim 27, wherein the processor determines the first end point of speech activity when a predetermined number of spectral representation vectors of the set of spectral representation vectors are a predetermined distance away from the steady state spectral representation vector for a continuous predetermined period of time.

* * * * *